United States Patent [101]

Dutcher

[11] 4,052,767

[45] Oct. 11, 1977

[54] POWER DRIVEN BRUSH DRIVE CONTROL

[75] Inventor: Ival G. Dutcher, White Bear Lake, Minn.

[73] Assignee: Whirlpool Corporation, Benton Harbor, Mich.

[21] Appl. No.: 629,845

[22] Filed: Nov. 7, 1975

[51] Int. Cl.[2] ..... A47L 9/28

[52] U.S. Cl. ..... 15/377; 15/410; 200/61.85; 200/153 T; 200/332

[58] Field of Search ..... 15/327 R, 339, 377, 15/410, 411, 412; 200/61.85, 153 T, 332

[56] References Cited

U.S. PATENT DOCUMENTS

| | | | |
|---|---|---|---|
| 918,930 | 4/1909 | Thurman | 15/410 X |
| 2,348,861 | 5/1944 | Smellie | 15/377 X |
| 2,842,788 | 7/1958 | Rench et al. | 15/410 X |
| 3,636,285 | 1/1972 | Wickham et al. | 15/377 X |

*Primary Examiner*—Christopher K. Moore

*Attorney, Agent, or Firm*—Wegner, Stellman, McCord, Wiles & Wood

[57] ABSTRACT

A vacuum cleaner structure having a motor driven suction unit and a motor driven rotary brush. A control is provided for selectively operating the driven brush independently of the operation of the suction unit. The control may comprise a switch mounted to a handle portion of the vacuum cleaner and may be biased to prevent operation of the driven brush upon release of the handle by the user.

9 Claims, 5 Drawing Figures

10
11
12
13
14
15
16
17
18
19
20
21
22
23
24
25
26
27
28
29
30
31
32
3

POWER DRIVEN BRUSH DRIVE CONTROL

BACKGROUND OF THE INVENTION

1. Field of the Invention

This invention relates to vacuum cleaners and in particular to control means for use therein.

2. Description of the Prior Art

In one conventional form of vacuum cleaner, as disclosed in U.S. Pat. No. 3,588,943 of Thomas E. Hetland, owned by the assignee hereof, a vacuum cleaner is provided with a switch adjacent a handle portion for controlling flow of electrical current to both a motor fan suction unit and a floor-contacting motor brush unit.

In the embodiment illustrated therein, the suction unit is housed in a canister portion of the vacuum cleaner and the floor-contacting brush unit comprises a separate unit connected to the canister by a flexible hose. A manual speed control switch mounted on the canister is provided for providing operation of the suction unit alone when desired. The control is arranged so that whenever the motor driven brush is energized, the suction motor is energized at low speed.

In another form of vacuum cleaner conventionally referred to as an upright vacuum cleaner, both the suction unit and brush unit are carried in a wheeled housing with the control for the electric drive thereof provided in a suitable switch on the manipulating handle. One example of such a vacuum cleaner is that shown in U.S. Pat. No. 1,393,509 of Frank C. DeReamer. In the DeReamer vacuum cleaner, a switch is provided in the handle which is biased to terminate operation of the entire vacuum cleaner when the user removes his hand from the handle grip portion.

In U.S. Pat. No. 1,955,967 of Ward Leathers, an automatic switch handle is provided which effects operation of the entire vacuum cleaner when the handle is gripped.

SUMMARY OF THE INVENTION

The present invention comprehends an improved vacuum cleaner construction provided with control means for selectively controlling the operation of a driven brush thereof independently of the operation of a motor driven suction unit thereof.

The vacuum cleaner control means of the present invention is adapted for use in either a canister or an upright type vacuum cleaner.

The control means may be arranged to control the operation of the driven brush from the gripping portion of the handle and may be biased to de-energize the driven brush whenever the user's grasp on the handle is released.

The driven brush may be provided with an electric motor separate from the motor driving the suction unit and the control means may comprise a normally open switch carried in the handle.

The actuator for the switch may comprise a spring member extending across an arcuate portion of the handle so as to be engaged by the user's fingers upon manipulating grasping of the handle by the user to automatically effect the desired energization of the brush motor.

Thus, the improved vacuum cleaner control means of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENTS

Figures 1, 2, 3, 4:
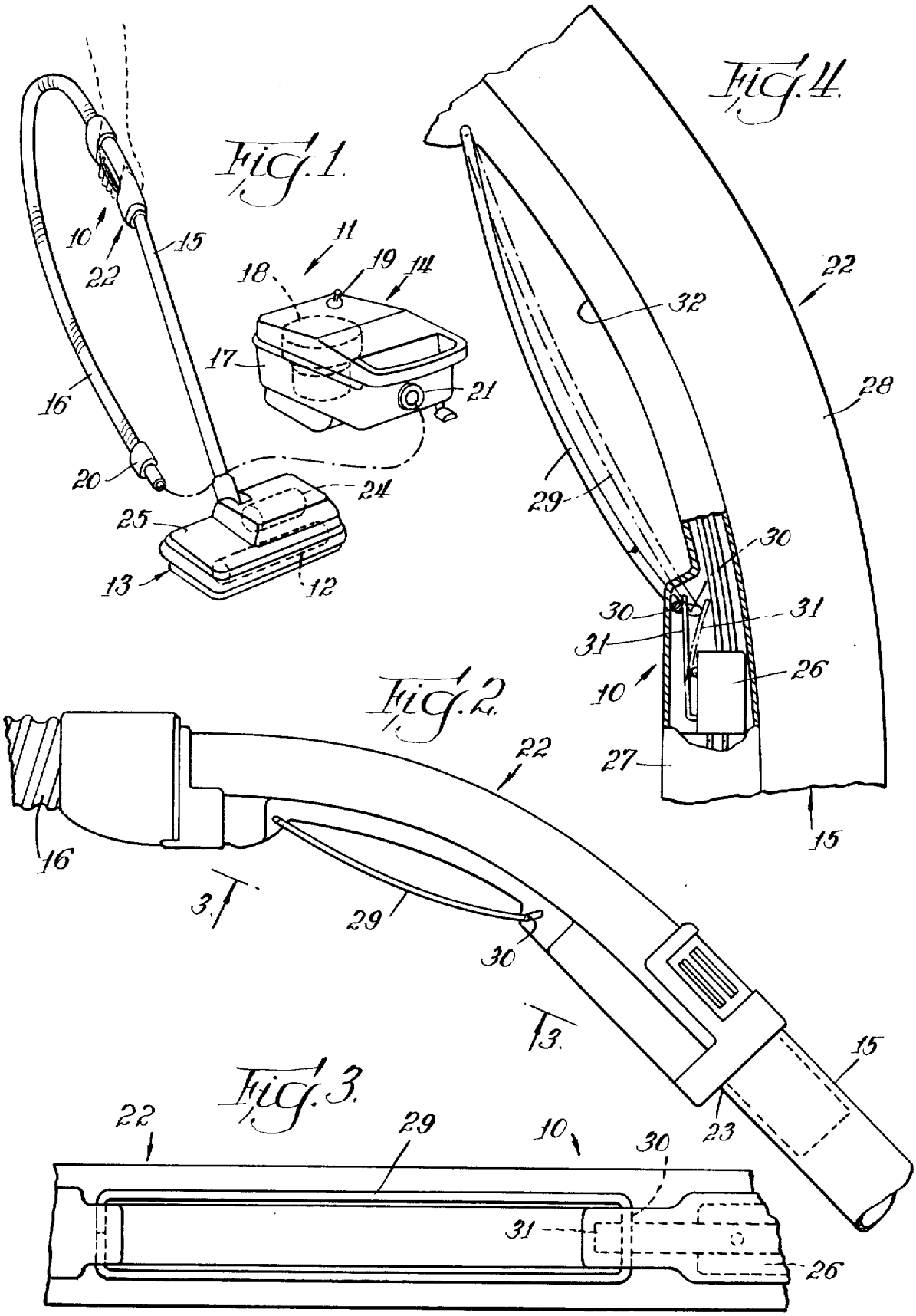
FIG. 1 is a perspective view of a vacuum cleaner provided with improved control means embodying the invention.
FIG. 2 is a fragmentary enlarged side elevation of the handle portion of the vacuum cleaner provided with the improved control means.
FIG. 3 is a plan view taken substantially along the line 3—3 of FIG. 2.
FIG. 4 is a further enlarged side elevation partly in section further illustrating the control means of the invention.

In the exemplary embodiment of the invention as disclosed in FIGS. 1–4 of the drawing, an improved control means generally designated 10 is provided in a vacuum cleaner generally designated 11 for controlling the operation of a driven rotary brush 12 provided in a dirt pickup means 13. In the embodiment of FIGS. 1–4, the vacuum cleaner comprises a canister type vacuum cleaner having a canister 14 connected to a handle 15 of the pickup means 13 by a flexible hose 16.

The canister defines a housing 17 in which is mounted a motor driven suction unit 18, the operation of which may be selectively controlled by a manual switch 19 on the housing. Hose 16 may include a first end 20 adapted to be received in a female connector 21 on canister housing 17, and a second handle end 22 adapted to be connected to end 23 of the handle 15.

Brush 12 may be suitably driven, such as by means of an electric motor 24 received within a housing 25 of the pickup unit 13, as shown in FIG. 1. Hose 16 may be provided with suitable electrical conductors (not shown) for providing electrical power to motor 24 when the hose is connected between canister 14 and pickup unit 13. The invention comprehends providing the control means 10 on the handle 22 for selectively controlling energization of the brush motor 24.

More specifically, control means 10 may include a normally open contact switch 26 mounted within a hollow portion 27 of a gripping portion 28 of handle 22, as best seen in FIG. 4.

Operation of switch 26 may be effected by manipulation of an actuator 29 which illustratively may comprise a resilient element defining an arcuate spring member having one end 30 adapted to engage an actuating portion 31 of switch 26 for selectively moving the actuator 31 from the full line position of FIG. 4, wherein switch 26 is open, to the dotted line position of FIG. 4 wherein switch 26 is closed. Thus control means 10 includes actuator means 29 for bridging the gripping portion 28 to preclude movement of the user's hand from either end of said actuator means to between said actuator means 29 and said gripping portion 28.

Actuator 29 may be formed of a suitable resilient material to have an arcuate configuration, as shown in FIGS. 2 and 4, extending convexly outwardly from an arcuate concave surface 32 defining an inner surface portion of the arcuate gripping portion 28 of handle 22.

Thus, when the gripping portion is grasped by the user as shown in FIG. 1, the springy actuator 29 moves from the full line position of FIG. 4 to the dotted line position thereof for correspondingly repositioning the actuator 31 of switch 26 to close the switch for energizing brush motor 24 as an incident of grasping of the handle.

Release of the handle by the user immediately de-energizes brush motor 24 as a result of the outward movement of the acutator 29 permitting the switch actuator 31 to be returned to the full line position of FIG. 4 wherein switch 26 is restored to the normally open condition.

Thus, operation of the brush motor 24 is independent of the operation of the motor driven suction unit 18 and is automatically effected by the normal manipulation of the pickup unit 13 in the use of the vacuum cleaner. If, for any reason, however, the user releases his hold on the handle portion 28, operation of the rotary brush 12 is immediately discontinued to avoid undesirable wear on the surface being cleaned, without requiring that operation of the suction unit be discontinued. Also, this lessens the chance of the user inadvertently coming in contact with brush 28 when it is operating.

Thus, a substantially improved operation of the vacuum cleaner 11 is obtained wherein the user may selectively effect rotation of the brush 12 without intermittent starting and stopping of the suction fan unit as required heretofore in known vacuum cleaner constructions utilizing motor driven brush means.

The use of the improved leaf spring acutator 29 provides a facilitated automatic operation of the motor driven brush while yet comprising an extremely simple and economical construction. As shown in FIG. 3, the spring leaf actuator 29 may be relatively broad for further improved facilitated manipulation.

Figure 5:
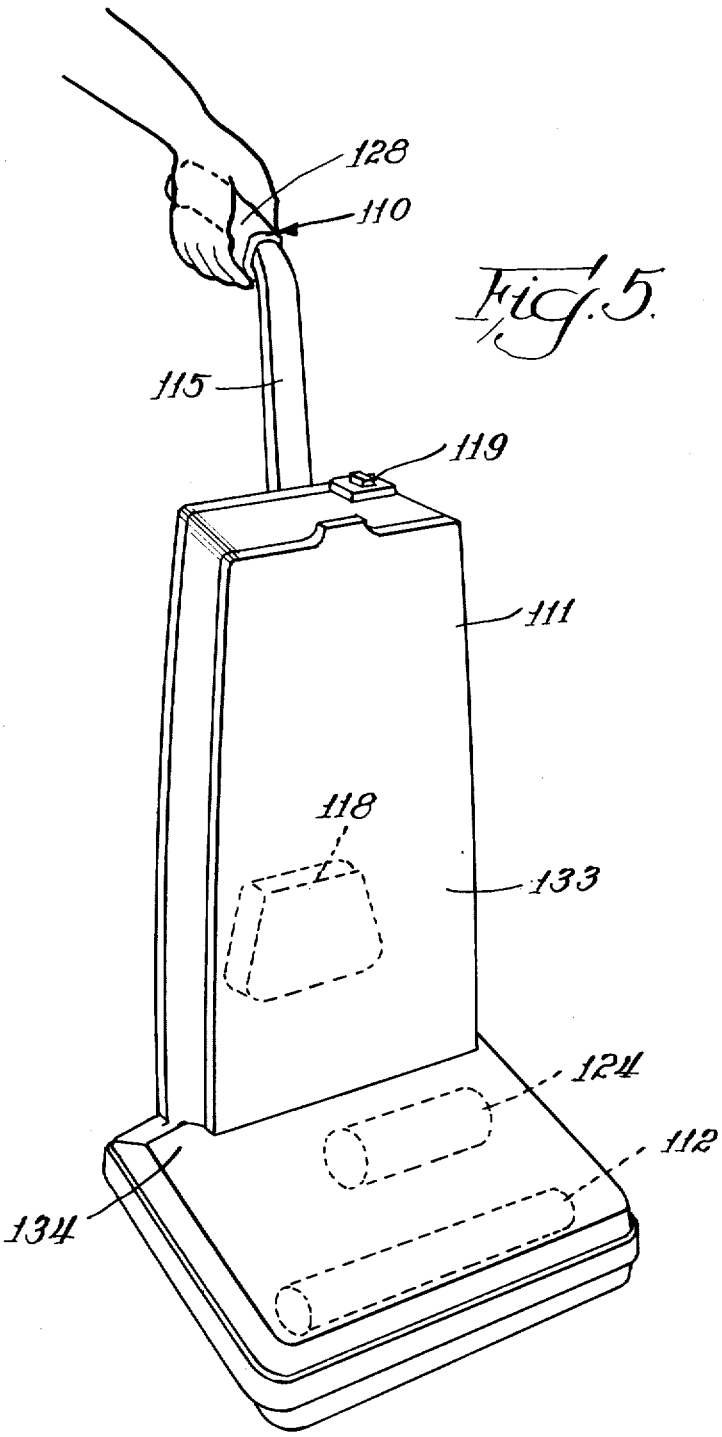
FIG. 5 is a side elevation of another form of vacuum cleaner provided with control means embodying the invention.

As indicated briefly above, the control of the driven brush in the dirt pickup means of the vacuum cleaner may be similarly effected in an upright vacuum cleaner 111, such as illustrated in FIG. 5, wherein the suction unit 118 is mounted in an upright housing portion 133 swingably connected to a base unit 134 housing the rotary brush 112 and the brush motor 124. The handle 115 may be provided with a grasping portion 128 having a control 110 similar to control means 10 of vacuum cleaner 11 with the suction unit being controlled for independent operation by a switch 119.

In the illustrated embodiments, the control of the driven brush comprises an electrical control. The invention comprehends the utilization of any suitable means for discontinuing driving of the rotary brush upon release of the grasping portion of the vacuum cleaner handle, including manual disengaging means, such as clutches and the like. The invention comprehends the disconnection of the brush drive independently of the suction unit of the vacuum cleaner in a dead-man type operation wherein the user's release of the manipulating portion of the vacuum cleaner effects the discontinuation of operation of the brush.

The present invention provides the further improved feature of permitting the user to utilize different attachments in association with an upright vacuum cleaner without requiring operation of the rotary brush while at all times permitting normal operation of the suction unit, thereby providing improved flexibility in the use of the vacuum cleaner.

By assuring that the rotary brush operation be discontinued when the user releases the handle, improved safety in the operation of the vacuum cleaner is provided by avoiding inadvertent contact with the rotating brush by the user's fingers or toes. Further, wear of the surface being cleaned as well as the brush itself is minimized by permitting the operation of the brush only when required in the vacuum cleaner operation.

The foregoing disclosure of specific embodiments is illustrative of the broad inventive concepts comprehended by the invention.

Having described the invention, the embodiments of the invention in which an exclusive property or privilege is claimed are defined as follows:

1. In a vacuum cleaner having a selectively operable motor driven suction unit, a dirt pickup means including a motor driven rotary brush for brushing the surface to be cleaned for facilitated dirt pickup therefrom by a pickup means, and a handle having a gripping portion to be gripped by a user in a gripping manner as required for moving the dirt pickup means along said surface, the improvement comprising control means carried by said handle at said gripping portion for selectively controlling the operation of the driven brush independently of the operation of the motor driven suction unit, said control means including an actuator means for bridging said gripping portion to preclude movement of the user's hand from either end of said actuator means to between said actuator means and said gripping portion, said actuator means being biased to prevent operation of the driven brush, the actuator means being arranged to be engaged by the hand of the user to cause operation of the driven brush whenever the user grips the handle gripping portion as required for moving the dirt pickup means along said surface.

2. The vacuum cleaner structure of claim 1 wherein said control means includes an electric switch mounted within said handle.

3. The vacuum cleaner structure of claim 1 wherein switch means is provided adjacent the suction unit for controlling the energization of the suction unit independently of said motor driven brush.

4. The vacuum cleaner structure of claim 1 wherein said handle gripping portion is arcuate and said actuator means comprises an arcuate leaf spring element.

5. The vacuum cleaner structure of claim 1 wherein said gripping portion is arcuate and said actuator means bridges a concave portion of said arcuate gripping portion.

6. The vacuum cleaner structure of claim 1 wherein said gripping portion is provided with a concave portion and said actuator means bridges said concave portion.

7. The vacuum cleaner structure of claim 1 wherein said gripping portion is provided with a concave portion and said actuator means bridges said concave portion, said concave portion comprising the underside of said gripping portion.

8. The vacuum cleaner structure of claim 1 wherein said control means includes a switch at one end of said actuator means for operation as an incident of movement of the actuator means.

9. The vacuum cleaner structure of claim 1 wherein said gripping portion is provided with a concave portion and said actuator means bridges said concave portion, said actuator means extending convexly across said concave portion.

* * * * *